United States Patent [19]

Schmidt

[11] Patent Number: 4,834,866

[45] Date of Patent: May 30, 1989

[54] PROCESS FOR CONVERTING NORMAL AND CYCLIC PARAFFINS

[75] Inventor: Robert J. Schmidt, Rolling Meadows, Ill.

[73] Assignee: UOP, Des Plaines, Ill.

[21] Appl. No.: 176,135

[22] Filed: Mar. 31, 1988

[51] Int. Cl.[4] ..... C10G 35/04

[52] U.S. Cl. ..... 208/65; 208/66; 208/79; 585/737

[58] Field of Search ..... 208/78, 79, 138, 139, 208/62, 133, 134, 66, 65; 585/737

[56] References Cited

U.S. PATENT DOCUMENTS

| | | | |
|---|---|---|---|
| 3,250,816 | 5/1986 | Waldby | 208/79 X |
| 4,457,832 | 7/1984 | Robinson | 208/66 |
| 4,747,933 | 5/1988 | Hibbs | 208/79 |

*Primary Examiner*—Glenn Caldarola

*Attorney, Agent, or Firm*—Thomas K. McBride; John G. Tolomei

[57] ABSTRACT

A process for splitting a feed containing $C_6$ cycloparaffins, $C_6$ normal paraffins, and higher boiling hydrocarbons uses an isomerization zone to open the rings of cyclic hydrocarbons and a single fractionation zone to separate the feed and the isomerization product into a $C_7$ plus stream that can be used as a feed stream to a reformer and an isoparaffin stream consisting of $C_6$ and lighter hydrocarbons that is deficient in cyclic hydrocarbons. The process uses a chlorided platinum-alumina catalyst to open rings and isomerize $C_6$ hydrocarbons. Additional feed streams of normal $C_5$ paraffins may be added to the process ahead of the isomerization zone to increase the yield of isoparaffin from the isomerization zone. This process offers a simple flow scheme that yields a high volume of high octane isomerate while reducing the quantity of $C_6$ cyclic hydrocarbons in a reformer feed. Converting the $C_6$ cyclic hydrocarbons to isoparaffins will reduce the benzene yield from the reformer feed while also increasing the combined liquid volume yield of the feed.

10 Claims, 1 Drawing Sheet

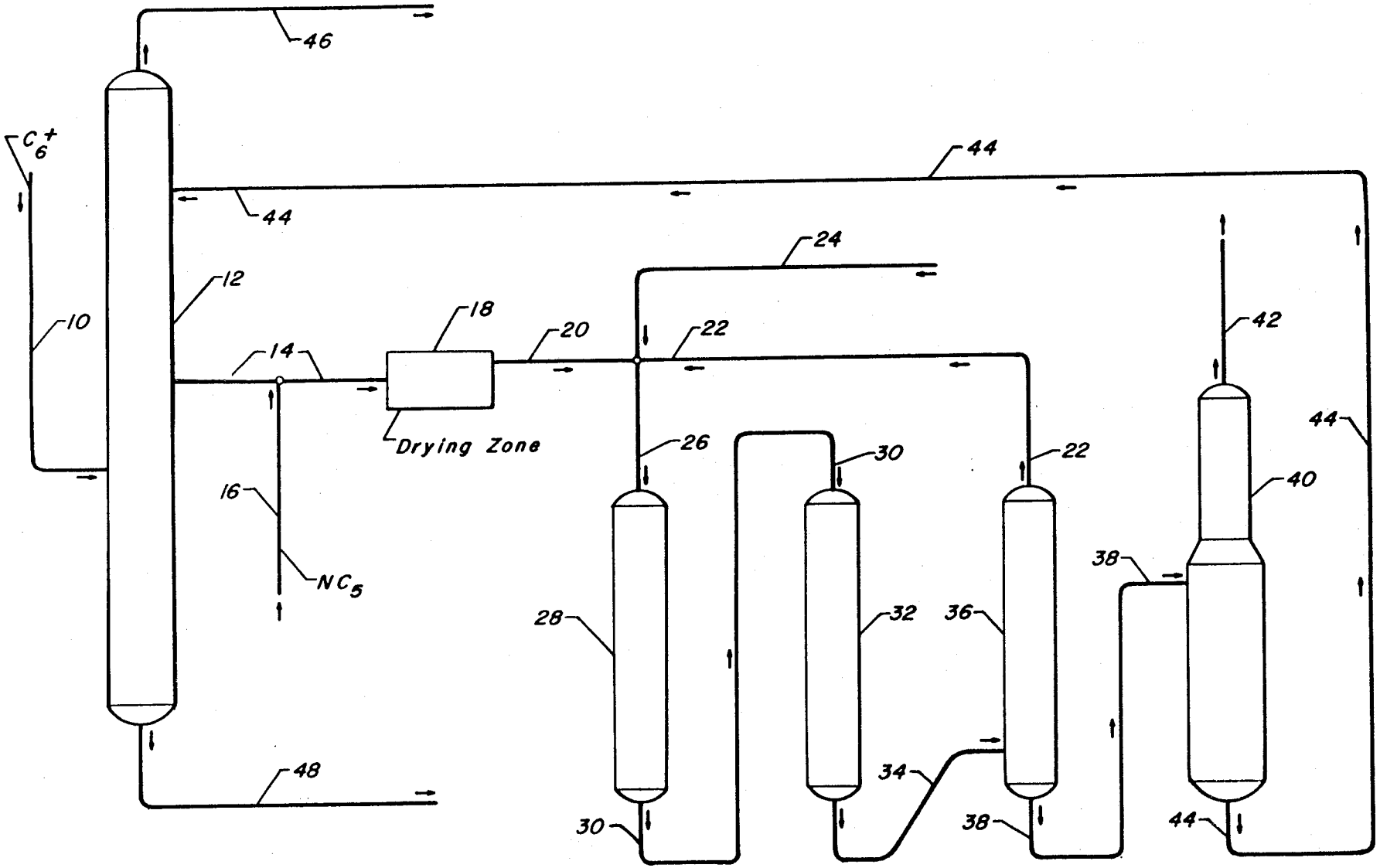
44
40
42
44
38
22
36
38
34
44
30
32
24
22
26
30
28
20
18
Drying Zone
46
44
14
NC5
16
48
12
10
C6+

PROCESS FOR CONVERTING NORMAL AND CYCLIC PARAFFINS

BACKGROUND OF THE INVENTION

This invention relates generally to the isomerization of hydrocarbons. This invention relates more specifically to the processing of $C_6$ to $C_8$ hydrocarbon feeds, the isomerization of light paraffins, and the opening of cyclic hydrocarbon rings.

DESCRIPTION OF THE PRIOR ART

High octane gasoline is required for modern gasoline engines. Formerly it was common to accomplish octane number improvement by the use of various lead-containing additives. As lead is phased out of gasoline for environmental reasons, it has become increasingly necessary to rearrange the structure of the hydrocarbons used in gasoline blending in order to achieve high octane ratings. Catalytic reforming and catalytic isomerization are two widely used processes for this upgrading.

A gasoline blending pool is usually derived from naphtha feedstocks and includes $C_4$ and heavier hydrocarbons having boiling points of less than 205° C. (395° F.) at atmospheric pressure. This range of hydrocarbon includes $C_4$–$C_9$ paraffins, cycloparaffins and aromatics. Of particular interest have been the $C_5$ and $C_6$ normal paraffins which have relatively low octane numbers. The $C_4$–$C_6$ hydrocarbons have the greatest susceptibility to octane improvement by lead addition and were formerly upgraded in this manner. Octane improvement can also be obtained by catalytically isomerizing the paraffinic hydrocarbons to rearrange the structure of the paraffinic hydrocarbons into branch-chained paraffins or reforming to convert the $C_6$ and heavier hydrocarbons to aromatic compounds. Normal $C_5$ hydrocarbons are not readily converted into aromatics, therefore, the common practice has been to isomerize these lighter hydrocarbons into corresponding branch-chained isoparaffins. Although the non-cyclic $C_6$ and heavier hydrocarbons can be upgraded into aromatics through hydrocyclization, the conversion of $C_6$'s to aromatics creates higher density species and increases gas yields with both effects leading to a reduction in liquid volume yields. Therefore, it is preferable to charge the non-cyclic $C_6$ paraffins to an isomerization unit to obtain $C_6$ isoparaffin hydrocarbons. Consequently, octane upgrading commonly uses isomerization to convert normal $C_6$ and lighter boiling hydrocarbons and reforming to convert $C_6$ cycloparaffins and higher boiling hydrocarbons.

In the reforming processing, $C_6$ cycloparaffins and other higher boiling cyclic hydrocarbons are converted to benzene and benzene derivatives. Since benzene and these derivatives have a relatively high octane value, the aromatization of these naphthenic hydrocarbons has been the preferred processing route. However, many countries are contemplating or have enacted legislation to restrict the benzene concentration of motor fuels. A process that can readily convert naphthenes to high octane isoparaffins will offer a needed alternative to upgrading the octane of the gasoline pool with benzene. In addition, due to the lower density of $C_6$ isoparaffins compared to benzene, such a process would not impose a significant penalty in terms of octane barrels.

Combination processes using isomerization and reforming to convert naphtha range feedstocks are well known. U.S. Pat. No. 4,457,832 uses reforming and isomerization in combination to upgrade a naphtha feedstock by first reforming the feedstock, separating a $C_5$–$C_6$ paraffin fraction from the reformate product, isomerizing the $C_5$–$C_6$ fraction to upgrade the octane number of these components and recovering a $C_5$–$C_6$ isomerate liquid which may be blended with the reformate product. U.S. Pat. Nos. 4,181,599 and 3,761,392 show a combination isomerization-reforming process where a full range naphtha boiling feedstock enters a first distillation zone which splits the feedstock into a lighter fraction that enters an isomerization zone and a heavier fraction that is charged as feed to a reforming zone. In both the '392 and '599 patents, reformate from one or more reforming zones undergoes additional separation and conversion, the separation including possible aromatics recovery, which results in additional $C_5$–$C_6$ hydrocarbons being charged to the isomerization zone.

It is also known in the art that further octane enhancement can be obtained by recycling at least a portion of the normal paraffins in the effluent of the isomerization zone back through the isomerization zone to obtain additional conversion of paraffins to isoparaffins. Separation facilities and flow schemes for recycling $C_5$ paraffins, $C_6$ paraffins or both through an isomerization unit are shown and described at pages 5–49 through 5–51 of *The Handbook of Petroleum Refining Processes* edited by Robert A. Meyers, published by McGraw Hill Book Company (1986). Recycling is particularly effective due to the equilibrium nature of the pentane and hexane isomerization reactions.

Schemes for recycling the effluent from an isomerization zone include return of at least a portion of the isomerization effluent to the separation facilities for initially splitting a straight-run naphtha feed into light and heavy fractions for the isomerization and reforming zone, respectively. U.S. Pat. No. 3,018,244 shows such an arrangement where a pentane fraction is recycled and combined with the fresh feed entering a series of fractionation columns for removing light components from the feed and separating the feed into light and heavy fractions for the isomerization and reforming sections. U.S. Pat. No. 2,946,736 shows a process flow scheme for an isomerization re-forming combination where at least a portion of the isomerization zone effluent is combined with a hydrotreated naphtha feed and the reforming zone effluent then enters a fractionation column for splitting the entering components into light and heavy fractions. The light fraction then undergoes further separation to remove isoparaffins and higher octane components from the normal paraffin hydrocarbons which are charged as feed to isomerization zone.

The isomerization of paraffins is a reversible first order reaction. The reaction is limited by thermodynamic equilibrium. The basic types of catalyst systems that are used in effecting the reaction are a hydrochloric acid promoted aluminum chloride system and a supported aluminum chloride catalyst. Either catalyst is very reactive and can generate undesirable side reactions such as disproportionation and cracking. These side reactions not only decrease the product yield but can form olefinic fragments that combine with the catalyst and shorten its life. One commonly practiced method of controlling these undesired reactions has been to carry out the reaction in the presence of hydrogen.

A large percentage of the $C_4$–$C_6$ paraffin fractions that are available as feedstocks for $C_4$–$C_6$ isomerization processes include cyclic hydrocarbons. These cyclic hydrocarbons tend to be absorbed on the isomerization catalysts. Absorption of the cyclic compounds blocks active sites on the catalyst and thereby excludes the isomerizable paraffins from the catalyst. This exclusion diminishes the overall conversion of the process. As a result, removal of cyclic hydrocarbons from an isomerization process has been generally practiced to increase conversion of the paraffins to more highly branched paraffins. Complete removal of cyclic hydrocarbons by ordinary separation cannot be achieved due to the boiling points of the $C_6$ paraffins and many of the cyclic hydrocarbons, in particular, normal hexane and methylcyclopentane.

It is also known to eliminate cyclic hydrocarbons by opening rings. U.S. Pat. No. 2,915,571 teaches the reduction of naphthenes in an isomerization feed fraction by contact with a ring opening catalyst containing an iron group metal in a first reaction zone, and subsequent isomerization of the feed fraction by contact with a different catalyst in an isomerization zone. Opening of the cyclic hydrocarbons has the two fold advantage of eliminating the cyclic hydrocarbons that can cause catalyst fouling and increasing the volume of lower density isomerizable hydrocarbons that in turn increases product yields. The use of different catalysts for ring opening and isomerization imposes a major drawback on the process of U.S. Pat. No. 2,915,571 since it requires at least one additional reaction zone. U.S. Pat. No. 3,631,117 describes a process for the hydro-isomerization of cyclic hydrocarbons that uses a zeolite supported Group VIII metal as a ring opening catalyst at high severity conditions and as an isomerization catalyst at low severity, conditions to obtain cyclic isomers having at least one less carbon atom per ring than the unconverted cyclic hydrocarbons. When high severity operating conditions are used to open rings, substantial cracking of $C_4$–$C_6$ hydrocarbons to light ends will also occur. Therefore, high severity conditions to open rings in $C_4$–$C_6$ hydrocarbon feedstocks are usually avoided.

The disadvantages of dual catalyst systems, additional reaction zones and production of light ends have provided substantial obstacles to the conversion of cyclic hydrocarbons contained in feedstocks of isomerizable $C_4$–$C_6$ hydrocarbons.

It has now been discovered that a hydrocarbon feed containing $C_6$ paraffins, cycloparaffins and higher boiling hydrocarbons can be split in a single fractionation zone that delivers the $C_6$ paraffins and cycloparaffins to an isomerization zone, receives an effluent from the isomerization zone having a reduced concentration of cycloparaffins, provides a product stream of $C_6$ isoparaffins and a feed stream of $C_7$ and higher boiling hydrocarbons for a reforming zone. The isomerization zone of this process uses a single catalyst system at low severity conditions to convert cyclic hydrocarbons and normal paraffins to branched chain paraffins.

Accordingly, it is an object of this invention to split a naphtha feedstock and obtain an increased yield of $C_6$ isoparaffins and a reforming feed of $C_7$ and higher boiling hydrocarbons.

It is a further object of this invention to increase the yield of $C_4$–$C_6$ branched chain paraffins in a paraffin isomerization process.

Another object of this invention is the cleavage of cyclic hydrocarbon and conversion to branch chain paraffins without reducing the carbon atoms in the resulting paraffins.

A yet further object of this invention is the isomerization of $C_6$ paraffins and the conversion of cyclic hydrocarbons to branch paraffins with a single catalyst system.

BRIEF DESCRIPTION OF THE INVENTION

This invention is a process for converting a feedstock comprising normal and cyclic paraffins having 6 carbon atoms and higher boiling hydrocarbon that achieves high conversion and good stability using an isomerization zone to open the rings of the $C_6$ cyclic hydrocarbons without appreciable chain shortening. The invention includes recycling the isomerization zone effluent to a fractionation zone and with-drawing a $C_6$ and lighter isomerate product and a reformer feed from the fractionation zone. The invention uses a highly active chlorided platinum/aluminum catalyst in the isomerization reaction which has been discovered to selectively open the rings of cyclic hydrocarbons at temperatures at or slightly greater than typical isomerization temperatures without generating light gases by subsequent cracking of opened rings. Eliminating the cyclic hydrocarbons by ring cleavage offers the dual advantages of increasing the activity and stability of the catalyst while also raising the liquid volume yields.

Thus, in one embodiment, the invention is a process for increasing the octane and volume of a hydrocarbon feedstock comprising $C_6$ normal paraffins, $C_6$ cycloparaffins and higher boiling hydrocarbons. In the process, the feedstream and a hereinafter defined recycle stream enters a fractionation zone. The fractionation zone provides a sidecut stream containing a majority of the $C_6$ cyclic hydrocarbons. The sidecut enters an isomerization zone where contact of the stream with an alumina catalyst containing from 0.1 to 0.25 wt. % platinum and from 2 to about 10 wt. % of a chloride component at a temperature of 40°–260° C. (500° F.), a pressure of 7 to 70 barsg, and a space velocity of 0.5 to 12 increases the degree of hydrocarbon branching and opens cyclic hydrocarbon rings. The effluent of the isomerization zone enters the fractionation zone as the aforementioned recycle stream. A higher boiling hydrocarbon stream comprising $C_7$ and higher boiling hydrocarbons is recovered from the fractionation zone. The fractionation zone also delivers a product stream consisting essentially of $C_6$ and lighter hydrocarbons that is deficient in cyclic hydrocarbons and rich in isohexane.

Other aspects of this invention relate to feedstream compositions, processing conditions, reaction zone arrangements and catalyst details.

BRIEF DESCRIPTION OF THE DRAWING

The FIGURE illustrates a flow arrangement for the isomerization process of this invention.

DETAILED DESCRIPTION OF THE INVENTION

The operation of this invention can be more fully appreciated from a review of the flow scheme presented in the FIGURE. The FIGURE or this description make no mention of pumps, compressors, receivers, condensors, reboilers, instruments and other well known items of processing equipment in order to simplify the explanation of the invention. A feed stream containing $C_6$ paraffins and cycloparaffins and higher boiling hydrocarbons passes from line 10 into fractionation zone 12. A $C_6$ sidecut taken above the boiling point of cyclohexane or benzene passes from fractionation into a line 14.

Additional relatively low octane $C_5$ paraffins may also be charged to the process through a line 16 that empties into line 14. The entire content of line 14 passes into a drying zone 18 for removing water from the isomerization feed before it contacts the water sensitive isomerization catalyst. Dry feed leaves zone 18 through line 20 where it is combined with recycle hydrogen from line 22 and makeup hydrogen from line 24. A line 26 carries the combined feed to a first isomerization reactor 28. After initial reaction, a line 30 carries the partially converted feed to a second isomerization reactor 32. Converted feed passes from the outlet of reactor 32 through a line 34 and into a product separator 36 hat removes hydrogen and other light hydrocarbons from the product stream as an overhead stream that provides the recycle hydrogen of line 22. The remainder of the isomerization zone effluent passes through a line 38 and into a stabilizer 40. Stabilizer 40 separates the remaining $C_3$ and lighter hydrocarbons from the isomerization zone effluent which exit the top of the stabilizer through a line 42 and provide a stabilized bottoms stream of the remaining heavier hydrocarbons that pass through line 44 and back to column 12 as a recycle stream. The column separates the feed from line 10 and the recycle from line 44 into the previously described sidecut of line 44, an overhead stream 46 of lighter hydrocarbons taken at a cut point in the boiling range methyl pentane, and a bottoms stream 48 containing primarily $C_7$ and heavier hydrocarbons.

Suitable feedstocks for this invention will include $C_4$ plus hydrocarbons up to an end boiling point of about 205° C. (400° F.). The feedstocks that are used in this invention will typically include hydrocarbon fractions rich in $C_4$–$C_6$ normal paraffins. The term "rich" is defined to mean a stream having more than 50% of the mentioned component. In addition, the feedstock will include cyclic hydrocarbons. In order to realize the advantages of this invention, the concentration of cyclics in the feedstock will at least equal that which would reduce the activity of an isomerization catalyst by adsorption of the cyclics thereon or which, due to its higher density in contrast to branched chain paraffins, would represent a significant loss of liquid volume yield. Normally, the minimum concentration is 2 wt. %. There is no upper limit on the concentration of cyclic hydrocarbons in the feed since the process of this invention can be used to process feedstocks composed primarily of cyclic hydrocarbons. However, the feedstock will usually contain from 3 to 35 wt. % of cyclic hydrocarbons. Possible types of cyclic hydrocarbons in the feed include alicyclic and aromatic hydrocarbons. If unsaturated cyclic hydrocarbons including benzene or benzene derivatives enter the process, they are rapidly saturated therein and effectively serve as additional cycloalkane components. The feed components will usually comprise $C_4$–$C_9$ cyclic and paraffinic hydrocarbons with normal and isohexane providing most of the paraffinic components. The feed will normally be debutanized and depentanized so these species may be separated into higher and lower octane components optionally returning the higher octane components returned to the isomerate product of the fractionator overhead. Hydrotreatment of the feed, prior to entering the fractionation zone, may also be desirable since the isomerization zone catalyst and the catalyst of any downstream reforming zone are often susceptible to sulfur deactivation.

The separation zone 12 of this invention has primarily two inputs, the feed and isomerization zone recycle; and three outputs, an isomerate product stream, an isomerization feed fraction and a heavy hydrocarbon stream. One or more fractionation columns can be included in the separation zone. It is expected that the sum of the trays in these columns will total 60 or more. The full range naphtha feed is introduced at or near the column midpoint at a location selected to provide a good split between the feed components. The fractionation zone initially splits the feed into a heavy hydrocarbon stream principally containing $C_7$ and higher boiling hydrocarbons and lighter hydrocarbon fractions boiling above the boiling point of cyclohexane. The heavy stream is typically withdrawn from the fractionation zone as a bottom stream and may contain small amounts of aliphatic and aromatic $C_6$ hydrocarbons which will not detract from the operation of the process.

The isomerization zone feed fraction is a relatively lighter boiling fraction that is removed as a sidecut from the fractionation zone. Sidecut location is selected to maximize cyclohexane concentration while limiting withdrawal of dimethylbutane and lower boiling hydrocarbons. The sidecut may be withdrawn as a liquid or vapor phase. Typically, this criteria results in a sidecut location above the feed inlet point.

At least a portion of the effluent from the isomerization zone returns to the fractionation zone as a recycle stream. The recycle stream is rich in $C_6$ isoparaffins and may contain lesser amounts of higher and lower boiling hydrocarbon species. It is, therefore, introduced at a column location above the sidecut withdrawal point so that the isoparaffins will go overhead and the $C_6$ normals will drop. Those skilled in the art will be able to optimize the recycle entry point to minimize $C_6$ normals and maximize $C_6$ isoparaffins in the isomerate.

The upper end of the fractionation zone is designed to drop normal $C_6$'s from the isomerization zone product stream. Normally, the isomerization zone product stream is withdrawn from the column as an overhead stream. The components of the isomerization product stream include $C_6$ isoparaffins and lighter boiling materials from both the feed stream and isomerization recycle stream.

Additional low octane paraffins may be added to the fractionation zone sidecut to increase the volume of the isomerization zone feed stream and provide a location for isomerizing other low octane paraffins. In most cases, the addition of $C_5$ hydrocarbons will offer the most benefit. Conditions within the isomerization zone usually promote favorable equilibrium distribution of both $C_5$ and $C_6$ paraffins. Therefore, substantial $C_5$ conversion can be obtained without any significant loss of $C_6$ conversion. Although $C_4$ hydrocarbons can be added, a higher severity, as compared to $C_5$ and $C_6$ paraffins, is required to obtain high yields of isobutane. In addition, the presence of appreciable $C_4$ s may present additional carryover problems in the product stabilizer for the isomerization zone. Therefore, the addition of $C_4$ hydrocarbons to the isomerization zone feed is not as beneficial as $C_5$ paraffin addition.

As hereinafter described in more detail, the isomerization zone catalyst of this invention is highly water sensitive. In order to keep water content within acceptable levels, all of the isomerization zone feed passes first through a drying zone. The drying zone may be of any design that will reduce water content to 0.1 ppm or less.

Suitable adsorption processes for this purpose are well known in the art.

Downstream of the dryers hydrogen is admixed with the feed in an amount that will provide a hydrogen to hydrocarbon ratio of from 0.01 to 10 in the effluent from the isomerization zone. Preferably, the hydrogen to hydrocarbon ratio is in the range of 0.05 to 5. Although no net hydrogen is consumed in the isomerization reaction, the isomerization zone will have a net consumption of hydrogen often referred to as the stoichiometric hydrogen requirement which is associated with a number of side reactions that occur. These side reactions include saturation of olefins and aromatics, cracking and disproportionation. For feeds having a high level of unsaturates, satisfying the stoichiometric hydrogen will require a higher hydrogen to hydrocarbon ratio for the feed at the inlet of the isomerization zone. Hydrogen in excess of the stoichiometric amounts for the side reactions is maintained in the reaction zone to provide good stability and conversion by compensating for variations in feedstream compositions that alter the stoichiometric hydrogen requirements and to prolong catalyst life by suppressing side reactions such as cracking and disproportionation. If left unchecked, the side reactions reduce conversion and lead to the formation of carbonaceous compounds, usually referred to as coke, that foul the catalyst.

When the hydrogen to hydrocarbon ratio exceeds 0.05, it is not economically desirable to operate the isomerization process without the recycle of hydrogen to the isomerization zone. Thus, recovery. facilities for hydrogen from the effluent will be provided. Hydrogen may be added to the feed mixture in any manner that provides the necessary control for the addition of the hydrogen quantities.

The hydrogen and hydrocarbon feed mixture is contacted in the reaction zone with an isomerization catalyst. The isomerization catalyst consists of a high chloride catalyst on an aluminum base containing platinum. The aluminum is preferably an anhydrous gamma-alumina with a high degree of purity. The catalyst may also contain other platinum group metals. The term platinum group metals refers to noble metals excluding silver and gold which are selected from the group consisting of platinum, palladium, germanium, ruthenium, rhodium, osmium, and iridium. These metals demonstrate differences in activity, and selectivity such that platinum has now been found to be the most suitable for this process. The catalyst will contain from about 0.1 to 0.25 wt. % of the platinum. Other platinum group metals may be present in a concentration of from 0.1 to 0.25 wt. %. The platinum component may exist within the final catalytic composite as an oxide or halide or as an elemental metal. The presence of the platinum component in its reduced state has been found most suitable for this process.

The catalyst also contains a chloride component. The chloride component termed in the art "a combined chloride" is present in an amount from about 2 to about 10 wt. % based upon the dry support material. The use of chloride in amounts greater than 5 wt. % have been found to be the most beneficial for this process.

There are a variety of ways for preparing the catalytic composite and incorporating the platinum metal and the chloride therein. The method that has shown the best results in this invention prepares the catalyst by impregnating the carrier material through contact with an aqueous solution of a water-soluble decomposable compound of the platinum group metal. For best results, the impregnation is carried out by dipping the carrier material in a solution of chloroplatinic acid. Additional solutions that may be used include ammonium chloroplatinate, bromoplatinic acid or platinum dichloride. Use of the platinum chloride compound serves the dual function of incorporating the platinum component and at least a minor quantity of the chloride into the catalyst. Additional amounts of the chloride must be incorporated into the catalyst by the addition or formation of aluminum chloride to or on the platinum-aluminum catalyst base. An alternate method of increasing the chloride concentration in the final catalyst composite is to use an aluminum hydrosol to form the aluminum carrier material such that the carrier material also contains at least a portion of the chloride. Halogen may also be added to the carrier material by contacting the calcined carrier material with an aqueous solution of the halogen acid such as hydrogen chloride.

It is generally known that high chlorided platinum-alumina catalysts of this type are highly sensitive to sulfur and oxygen-containing compounds. Therefore, the feedstock must be relatively free of such compounds. A sulfur concentration no greater than 0.5 ppm is generally required. The presence of sulfur in the feedstock serves to temporarily deactivate the catalyst by platinum poisoning. Activity of the catalyst may be restored by hot hydrogen stripping of sulfur from the catalyst composite or by lowering the sulfur concentration in the incoming feed to below 0.5 ppm so that the hydrocarbon will desorb the sulfur that has been adsorbed on the catalyst. Water can act to permanently deactivate the catalyst by removing high activity chloride from the catalyst and replacing it with inactive aluminum hydroxide. Therefore, water, as well as oxygenates, in particular $C_1$–$C_5$ oxygenates, that can decompose to form water, can only be tolerated in very low concentrations. In general, this requires a limitation of oxygenates in the feed to about 0.1 ppm or less. The feedstock may be treated by any method that will remove water and sulfur compounds. Sulfur may be removed from the feedstream by hydrotreating. A variety of commercial dryers are available to remove water from the feed components. Adsorption processes for the removal of sulfur and water from hydrocarbon streams are also well known to those skilled in the art.

In this invention, it is also recognized that cyclic hydrocarbons, especially $C_6$ cyclics such as benzene, cyclohexane and methylcyclopentane adversely affect the degree of paraffin isomerization. The adverse effect is believed to be caused by preferential adsorption of the cyclic hydrocarbons on the catalyst surface and the resulting exclusion of the paraffinic hydrocarbons. The process of this invention uses the aforementioned catalyst at selected operating conditions to eliminate the cyclics by their contact therewith while converting the cyclics to provide additional isomerization product. It is not necessary to achieve a complete elimination of the rings in order to enjoy the benefits of this invention. Conversion of only a small wt. % of the rings in the entering feed will provide a substantial increase in the isoparaffin yield. Generally, the process will be operated to open at least 40 wt. % of the rings in the entering feed. When the cyclic hydrocarbon concentration of the feed exceeds 20%, a greater degree of ring opening may be sought such that the cyclic hydrocarbon concentration in the effluent from the reaction zone is kept below 5 wt. %. Temperature and pressure conditions directly affect the degree of ring opening. Operating conditions within the isomerization zone are selected to maximize the production of isoalkane product from the feed components. Temperatures within the reaction zone will usually range from about 40°-260° C. (105°-500° F.). Lower reaction temperatures are preferred for purposes of isomerization conversion since they favor isoalkanes over normal alkanes in equilibrium mixtures. However, maximizing ring opening sometimes requires temperatures in excess of those that are most favorable from an equilibrium standpoint. For example, when the feed mixture is primarily $C_5$ and $C_6$ alkanes, temperatures in the range of 60°-160° C. are desired from a normal-isoalkane equilibrium standpoint but, due to ring opening considerations, the preferred temperature range for this invention lies between 100°-200° C. When it is desired to also isomerize significant amounts of $C_4$ hydrocarbons, higher reaction temperatures are required to maintain catalyst activity. Thus, when the feed mixture contains significant portions of $C_4$-$C_6$ alkanes the most suitable operating temperatures for ring opening and isoalkane equilibrium coincide and are in the range from 145°-225° C. The reaction zone may be maintained over a wide range of pressures. Pressure conditions in the isomerization of $C_4$-$C_6$ paraffins range from 7 barsg to 70 barsg. Higher pressures favor ring opening, therefore, the preferred pressures for this process are in the range of from 25 barsg to 60 barsg. The feed rate to the reaction zone can also vary over a wide range. These conditions include liquid hourly space velocities ranging from 0.5 to 12 $hr.^{-1}$, however, space velocities between 0.5 and 3 $hr.^{-1}$ are preferred.

Operation of the reaction zone also requires the presence of a small amount of an organic chloride promoter. The organic chloride promoter serves to maintain a high level of active chloride on the catalyst as small amounts of chloride are continuously stripped off the catalyst by the hydrocarbon feed. The concentration of promoter in the reaction zone is maintained at from 30 to 300 ppm. The preferred promoter compound is carbon tetrachloride. Other suitable promoter compounds include oxygen-free decomposable organic chlorides such as propyldichloride, butylchloride, and chloroform to name only a few of such compounds. The need to keep the reactants dry is reinforced by the presence of the organic chloride compound which may convert, in part, to hydrogen chloride. As long as the process streams are kept dry, there will be no adverse effect from the presence of small amounts of hydrogen chloride.

A preferred manner of operating the process is in a two-reactor or reaction zone system. The catalyst used in the process can be distributed equally or in varying proportions between the two reactors. The use of two reaction zones permits a variation in the operating conditions between the two reaction zones to enhance cyclic hydrocarbon conversion in one reaction zone and normal paraffin isomerization in the other. In this manner, the first reaction zone operates at higher temperature and pressure conditions that favor ring opening and performs only a portion of the normal to isoparaffin conversion. The likelihood of exothermic reactions, such as the hydrogenation of unsaturates, occurring in the initial portion of the reaction zone facilitates the use of higher temperatures therein. Once the rings have been opened by initial contact with the catalyst, the final reactor stage may operate at temperature conditions that are more favorable for isoalkane equilibrium.

Another benefit of using two reactors is that it allows partial replacement of the catalyst system without taking the isomerization unit off stream. For short periods of time, during which the replacement of catalyst may be necessary, the entire flow of reactants may be processed through only one reaction vessel while catalyst is replaced in the other.

Whether operated with one or two reaction zones, the effluent of the process will enter separation facilities in the recovery of an isoalkane product. At minimum, the separation facilities divide the reaction zone effluent into a product stream comprising $C_4$ and heavier hydrocarbons and a gas stream which is made up of lighter hydrocarbons and hydrogen. Suitable designs for rectification columns and separator vessels are well known to those skilled in the art.

In FIG. 1, the separation facilities consist of a product separator 36 and a stabilizer 40. The product separator operates as a simple flash separator that produces a vapor stream rich in hydrogen with the remainder of its volume principally comprising $C_1$ and $C_2$ hydrocarbons. The vapor stream serves primarily as a source of recycle hydrogen which is usually returned directly to the isomerization process. The separator may contain packing or other liquid vapor separation devices to limit the carryover of hydrocarbons. The presence of $C_1$ and $C_2$ hydrocarbons in the vapor stream do not interfere with the isomerization process, therefore, some additional mass flow for these components is accepted in exchange for a simplified column design. The remainder of the isomerization effluent leaves the separator as a liquid which passes on to stabilizer 40.

Stabilizer 40 is a trayed column containing approximately 40 trays. The column will ordinarily contain condensing and reboiler loops for the withdrawal of a light gas stream 42 comprising at least a majority of the remaining $C_4$ hydrocarbons from the feed stream and a liquid bottoms stream 44 comprising $C_5$ and heavier hydrocarbons. Normally when the isomerization zone contains only a small quantity of $C_4$ hydrocarbons, the $C_4$'s are withdrawn with the light gas stream. After caustic treatment for the removal of chloride compounds, the light gas stream will ordinarily serve as a fuel gas. The stabilizer liquid, which represents the remainder of the isomerization zone effluent passes back to the fractionation zone as recycle input.

In order to more fully illustrate the process, the following example is presented of the operation of the process utilizing the flow scheme of the FIGURE. This example is based in part on a computer simulation of the process and experience with other isomerization and fractionation systems. All of the numbers identifying vessels and lines correspond to those given in the FIGURE.

A $C_6$ plus naphtha feed having the composition given in Table 1 enters fractionation column 12 through line 10 at a temperature of 129° C. (265° F.) and a pressure of 2.4 barsg. Fractionation column 12 has 67 trays and the feed enters above tray 13. A recycle stream having the composition given in the table enters column 12 above tray 49 at a temperature of 93° C. (200° F.) and a pressure of 3.4 barsg. The column splits the two inputs into a bottoms stream 48 and overhead stream 46 and a sidecut stream 14, taken from the column at a location above tray 32. An additional 70 kmol/hr of pentane and 23 kmol/hr of isopentane are added to the sidecut. The combined sidecut stream is dried by. passage through adsorption beds to a water center of less than 0.1 ppm and then combined with recycle and dry. make-up hydrogen in an amount equal to 1180 kmol/hr to provide a combined isomerization zone feed.

The feed enters the reactor train 28 and 29 at a temperature of 171° C. (340° F.) and a pressure of 33.1 barsg. Therein the isomerization zone feed contacts an alumina catalyst having 0.25 wt. % platinum and 5.5 wt. % chlorine which was prepared by vacuum impregnating an alumina base in a solution of chloroplatinic acid, 2% hydrochloric acid, and 3.5% nitric acid in a volume ratio of 9 parts solution to 10 parts base to obtain a peptized base material having a platinum to base ratio of approximately 0.9. The preparation also included cold-rolling the catalyst for approximately 1 hour followed by evaporation until dry. Afterward, the catalyst was oxidized and the chloride content adjusted by contact with a 1M hydrochloric acid solution at 525° C. (975° F.) at a rate of 45 cc/hr for 2 hours. The catalyst was then reduced in electrolytic hydrogen at 565° C. (1050° F.) for 1 hour and was found to contain approximately 0.25 wt. % Pt and approximately 1 wt. % chloride. Impregnation of active chloride to a level of approximately 5.5 wt. % was accomplished by sublimating aluminum chloride with hydrogen and contacting the catalyst with the sublimated aluminum chloride for approximately 45 minutes at 550° C. (1020° F.). The converted isomerization zone feed passed out of the reactor train at a temperature of 204° C. (400° F.) and a pressure of 31 barsg and has the composition listed under stream 34 in the table.

The isomerization effluent passed into a product recovery section for the recovery of a recycle stream. After cooling to a temperature of 38° C. (100° F.), the isomerization zone effluent entered a product separator 36 from where a bottoms stream 38, given in the Table and an overhead stream 22 containing 1241 kmol/hr of hydrogen were withdrawn. The overhead was combined with the feed to provide the previously mentioned recycle hydrogen. The bottoms stream entered stabilizer 40 at a temperature of 125° C. (245° F.) and a pressure of 18 barsg. The stabilizer was a trayed column having 30 trays with the bottoms stream 38 entering the stabilizer above tray 15. A fuel gas stream 42 having the composition given in the Table was withdrawn overhead while the bottoms stream, representing the remainder of the isomerization effluent was returned to column 12.

| | Stream Composition in kmol/hr | | | | | | |
|---|---|---|---|---|---|---|---|
| | Stream Number | | | | | | |
| Component | 10 | 44 | 48 | 46 | 14 | 34 | 42 |
| hydrogen | 0 | — | — | — | — | 1190 | 12 |
| $C_1$–$C_4$ | 0 | 9 | 0 | 9 | — | 452 | 94 |
| isopentane | 3 | 68 | 0 | 70 | 1 | 79 | — |
| normal pentane | 7 | 24 | 0 | 30 | 2 | 27 | 0 |
| cyclopentane | — | 4 | 0 | 4 | — | 4 | 0 |
| dimethyl butane | 4 | 131 | 0 | 114 | 20 | 141 | 0 |
| methyl pentane | 47 | 198 | 0 | 83 | 163 | 210 | 0 |
| normal hexane | 41 | 47 | — | 3 | 84 | 49 | 0 |
| methyl cyclopentane | 67 | 41 | 2 | — | 106 | 42 | 0 |
| cyclohexane | 70 | 41 | 22 | — | 88 | 42 | 0 |
| benzene | 9 | — | — | — | 9 | 0 | 0 |
| $C_7$ and higher hydrocarbons | 679 | 5 | 661 | 1 | 24 | 5 | 0 |

This example demonstrates the ability of the process to separate the feed and recycle components entering the fractionation column into an isomerization product containing highly branched $C_6$ and lower paraffins and a reformer feed deficient in $C_6$ cyclic hydrocarbons. Only one quarter of the 228 kmol/hr of $C_6$ cyclic hydrocarbon that entered column 12 were withdrawn with the reformer feed. The majority of these $C_6$ cyclic hydrocarbons were converted to isoparaffins and make up part of the isomerate taken from the top of column 12. The high conversion of cyclic $C_6$ isoparaffins is demonstrated by the composition of the column overhead and bottoms streams that show almost 90% of the $C_6$ hydrocarbons leave the process as $C_6$ isoparaffins. Thus, the process is highly useful in its ability to produce large quantities of $C_6$ isoparaffins from $C_6$ cycloparaffins and normal paraffin feeds.

What is claimed is:

1. A process for increasing the octane and volume of a hydrocarbon feedstream comprising $C_6$ paraffins, $C_6$ cycloparaffins, and higher boiling hydrocarbons, wherein the feedstream contains at least 2 wt. % cyclic hydrocarbons, said process comprising:

(a) passing said feedstream and a recycle stream to a fractionation zone (b) withdrawing a sidecut comprising $C_6$ hydrocarbons and a majority of the $C_6$ cyclic hydrocarbons entering said fractionation zone;

(c) charging said sidecut to an isomerization zone and contacting said stream with a catalyst comprising alumina, from 0.1 to 0.25 wt. % platinum, and from 2 to 10 wt. % of a chloride component at conditions including a temperature in the range of 40°–260° C. (105°–500° F.), a pressure of from 7 to 70 barsg and a space velocity of from 0.5 to 12, to increase the degree of chain branching and open at least 40 wt. % of the cyclic hydrocarbon rings in said feedstream;

(d) maintaining a chloride concentration of from 30 to 300 ppm in said isomerization zone;

(e) recovering an effluent from said isomerization zone and returning said effluent to said fractionation zone as said recycle stream;

(f) recovering a second stream from said fractionation zone comprising $C_7$ and higher boiling hydrocarbons; and (g) recovering a third stream from said fractionation zone, said third stream consisting essentially of $C_6$ and lighter hydrocarbons.

2. The process of claim 1 wherein a feedstream comprising $C_5$ hydrocarbons is combined with said sidecut and enters in admixture therewith.

3. The process of claim 1 wherein said reaction is carried out in at least two reaction zones and the first of said reaction zones is operated at a higher temperature.

4. The process of claim 2 wherein said isomerization conditions include a temperature in the range of from 120°–180° C. (250°–360° F.), a pressure in the range of 25 to 60 barsg and a space velocity of from 0.1 to 3.

5. The process of claim 1 wherein said isomerization conditions include a temperature of at least 160° C. (320° F.), a pressure of at least 45 barsg and a space velocity of less than 2.

6. The process of claim 1 wherein said feed stream includes to 35 wt. % cyclic hydrocarbons.

7. The process of claim 3 wherein the space velocity in said reaction zones is less than 3, the pressure in said reaction zones is at least 30 barsg, the temperature in said first reaction zone is at least 180° C. (360° F.) and the temperature in said second reaction zone is less than 280° C. (360° F.).

8. A process for increasing the octane and volume of a hydrocarbon feedstock comprising $C_6$ normal paraffins, $C_6$ cycloparaffins and higher boiling hydrocarbons, wherein the feedstream contains at least 2 wt. % cyclic hydrocarbons, said process comprising:

(a) passing a naphtha feedstream comprising $C_6$ and higher boiling hydrocarbons to a fractionation column;

(b) withdrawing a sidecut comprising $C_6$ hydrocarbons and a majority of the cyclic hydrocarbons entering said column;

(c) charging said sidecut to an isomerization zone comprising at least two reaction vessels and contacting said stream with a catalyst comprising alumina, from 0.1 to 0.25 wt. % platinum, and from 2 to 10 wt. % of a chloride component at conditions including a temperature in the range of 40°–260° C. (105°–500° F.), a pressure of from 7 to 70 barsg and a space velocity of from 0.5 to 12, to increase the degree of chain branching and open at least 40 wt. % of the cyclic hydrocarbon rings in said feedstream;

(d) maintaining a chloride concentration of from 30 to 300 ppm in said isomerization zone;

(e) recovering an effluent from said isomerization zone and returning said effluent to said fractionation column;

(f) recovering a bottoms stream from said column comprising $C_7$ and higher boiling hydrocarbons; and (g) recovering an overhead stream from said column, said overhead consisting essentially of $C_6$ and lighter hydrocarbons.

9. The process of claim 8 wherein a feedstream comprising $C_5$ hydrocarbons is admixed with said sidecut.

10. The process of claim 9 wherein the space velocity in said reaction zones is at least 30 barsg and the temperature in said first reaction zone is at least 180° C. (355° F.) and the temperature in said second reaction zone is less than 280° C. (535° F.).

* * * * *